United States Patent [19]

Fohl et al.

[11] Patent Number: 4,499,396

[45] Date of Patent: Feb. 12, 1985

[54] METAL HALIDE ARC DISCHARGE LAMP WITH MEANS FOR SUPPRESSING CONVECTION CURRENTS WITHIN THE OUTER ENVELOPE AND METHODS OF OPERATING SAME

[75] Inventors: Timothy Fohl, Carlisle; William M. Keeffe, Rockport; Harold L. Rothwell, Rowley, all of Mass.

[73] Assignee: GTE Products Corporation, Stamford, Conn.

[21] Appl. No.: 409,280

[22] Filed: Aug. 18, 1982

[51] Int. Cl.[3] ..... H01J 61/34; H01J 61/18

[52] U.S. Cl. ..... 313/25; 313/634; 313/638

[58] Field of Search ..... 313/25, 26, 638, 642, 313/634

[56] References Cited

U.S. PATENT DOCUMENTS

| | | | |
|---|---|---|---|
| 2,177,755 | 10/1939 | Uyterhoeven | 313/25 |
| 2,270,276 | 1/1942 | Doering | 313/25 X |
| 3,250,934 | 5/1966 | Peterson | 313/634 X |
| 3,379,916 | 4/1968 | Delrieu et al. | 313/25 X |
| 4,199,701 | 4/1980 | Bhattacharya | 313/25 |
| 4,281,274 | 6/1981 | Bechard et al. | 315/49 |
| 4,302,699 | 11/1981 | Keeffe et al. | 313/642 X |
| 4,338,540 | 7/1982 | Sovilla | 313/579 |
| 4,401,913 | 8/1983 | Koza et al. | 313/634 X |

FOREIGN PATENT DOCUMENTS

| | | | |
|---|---|---|---|
| 852783 | 11/1960 | United Kingdom | 313/25 |
| 1557731 | 12/1979 | United Kingdom | 313/642 |
| 2035679 | 6/1980 | United Kingdom | 313/25 |

*Primary Examiner*—Palmer Demeo

*Attorney, Agent, or Firm*—Joseph S. Romanow

[57] ABSTRACT

A metal halide arc discharge lamp having a gaseous fill within the outer envelope and means for suppressing convection currents within such fill; and methods of operating and constructing such lamps. A light-transmissive sleeve or enclosure surrounding the arc tube laterally and about at least one end thereof is so shaped and mounted with respect to the arc tube as to insure that the Rayleigh Number, a quantitative measure of convection flow, in the atmosphere laterally surrounding the arc tube will be less than $5 \times 10^4$ during operation of the lamp whereby excessive convective heat loss in such lamp will be effectively suppressed.

11 Claims, 4 Drawing Figures

METAL HALIDE ARC DISCHARGE LAMP WITH MEANS FOR SUPPRESSING CONVECTION CURRENTS WITHIN THE OUTER ENVELOPE AND METHODS OF OPERATING SAME

TECHNICAL FIELD

This invention relates to the field of metal halide arc discharge lamps with means for suppressing convection currents within the outer envelope during operation of such lamps and to methods of operating and constructing these lamps.

BACKGROUND ART

Metal-halide arc discharge lamps are well known. They are frequently employed in commericial usage because of their high luminous efficacy and long life. See IES Lighting Handbook, 1981 Reference Volume, Section 8.

The terms "efficacy" or "luminous efficacy" used herein are a measure of the total luminous flux emitted by a light source over all wavelengths expressed in lumens divided by the total power input of the source expressed in watts. The terms "maintenance" or "luminous maintenance" herein denote the ratio of the illuminance on a given area after a period of time to the illuminance on the same area by the same lamp at an initial or benchmark time; the maintenance ratio is a dimensionless number usually expressed as a percentage.

A typical commercial metal halide arc discharge lamp comprises a quartz or fused silica arc tube hermetically sealed within a borosilicate glass outer envelope. The arc tube, itself hermetically sealed, has tungsten electrodes sealed into its ends and contains a fill comprising mercury, metal halide additives, and a rare gas to facilitate starting. The outer envelope is generally filled with nitrogen or another inert gas at less than atmospheric pressure.

One problem associated with metal halide lamps is sodium loss from within the arc tube. Most metal halide lamps contain a sodium compound as one ingredient of the arc tube fill. It has been postulated that during operation of the lamp, a photoelectric process caused by a flux of ultraviolet radiation emitted from the arc tube and incident upon the frame parts liberates electrons which migrate to and collect on the arc tube. The electrons on the outside of the arc tube create an electric field which draws sodium ions through the arc tube walls into the atmosphere of the outer envelope. This process depletes the sodium from within the arc tube causing diminished efficacy and maintenance and, ultimately, reduced lamp life. For a more detailed explanation of sodium loss, see *Electric Discharge Lamps,* by John F. Waymouth, The M. I. T. Press, 1971, Chapter 10, and further references cited therein.

Another problem, which is associated with metal halide lamps having a phosphor coating on the inside of the outer envelope, is the reaction of the phosphors with reducing agents. The phosphors used in high intensity discharge lamps are limited to very stable phosphors, such as the orthovanadates, because of the high ambient temperatures. The orthovandates, being metal oxides, are subject to being reduced by the presence of a reducing agent, such as hydrogen, in the atmosphere of the outer envelope. This causes an accelerated loss of phosphor efficiency and increases phosphor absorption of emitted light due to darkening.

Yet another problem experienced with metal halide lamps is the possibility of striking an electrical arc between the lead-in wires of the external circuit. This "arc-over" problem is especially significant when the atmosphere of the outer envelope is at low pressure, e.g., between 50 microns and 10 torr. For a more detailed explanation of the arc-over problem, including typical Paschen curves showing ignition potential as a function of fill pressure for various gases, see *Light Sources,* by W. Elenbaas, Crane, Russak & Co., Inc., New York, 1972.

Still another problem of metal halide lamps is heat loss from the arc tube by means of convective currents within the atmosphere of the outer envelope. It is generally true that the overall efficiency of a metal halide lamp is improved with higher operating temperatures of the arc tube wall. Higher operating temperatures cause greater quantities of the metal halide additives to be in the vapor state. An excess of the additives is usually provided to insure a saturated vapor state within the arc tube. With more vaporized additives, the luminous output and color temperature of the lamp are improved in most cases. Therefore, it is important to keep heat lost through convection at a minimum.

In metal halide lamps of lower wattage, e.g., 100 watts or less, avoidance of convective heat loss is a principal concern. Consequently, lamp manufacturers have been constrained to have a vacuum or near vacuum in the outer envelope despite the possible benefits which would be concomitant with greater fill pressures.

In metal halide lamps of higher wattage, e.g., 175 watts or higher, convective heat loss is not so critical as to compel a near vacuum in the outer envelope. These lamps generally contain an outer envelope fill having cold pressure of approximately one-half of an atmosphere. Nevertheless, convective heat loss adversely affects the efficacy and luminous maintenance of these lamps.

In U.S. Pat. No. 4,281,274, issued July 28, 1981, to Bechard et al., there is disclosed a glass shield surrounding the arc tube of a metal halide arc discharge lamp. It is suggested that the shield prevents sodium loss from the arc by trapping ultraviolet radiation and by shielding the arc tube from photoelectrons.

DISCLOSURE OF THE INVENTION

It is, therefore, an object of this invention to obviate the deficiencies of the prior art.

A further object of the invention is to reduce convective heat loss in metal halide lamps having substantial outer envelope fill pressures and thereby improve the operating characteristics of such lamps.

Another object of this invention is to reduce sodium loss in metal halide lamps.

Still another object of this invention is to improve the maintenance of phosphor efficiency in metal halide lamps having a phosphor coating on the inside surface of the outer envelope.

Yet another object of this invention is to improve the safety of metal halide lamps.

These objects are accomplished, in one aspect of the invention, by the provision of a metal halide lamp with a substantial outer envelope fill pressure and including therewith means for suppressing convection currents within the atmosphere of the outer envelope.

BEST MODE FOR CARRYING OUT THE INVENTION

Figure 1:
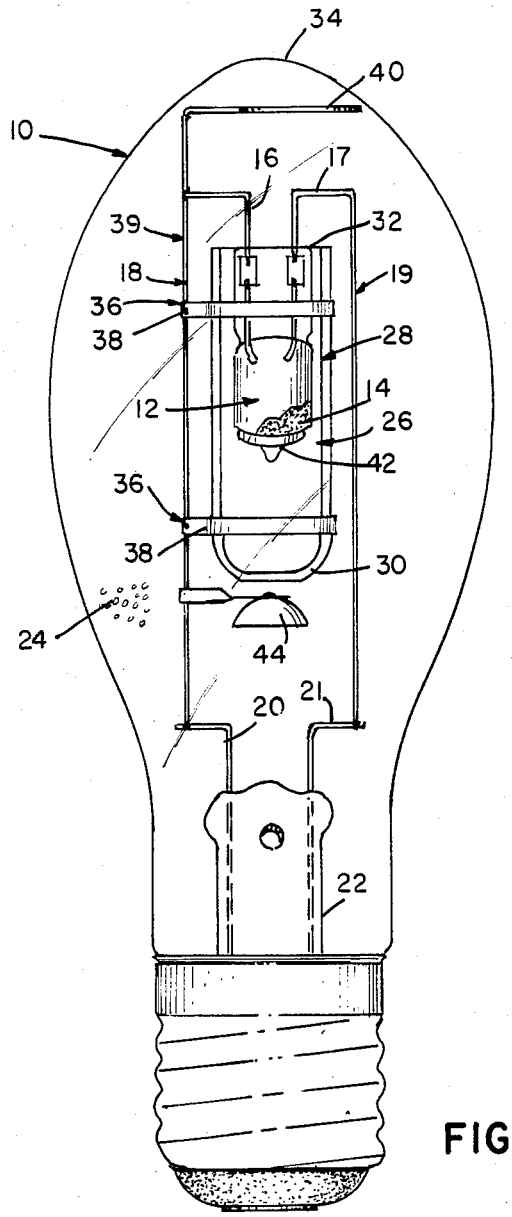
FIG. 1 is an elevational view of an embodiment of the invention in a metal halide lamp with a single-ended arc tube.

For a better understanding of the present invention, together with other and further objects, advantages, and capabilities thereof, reference is made to the following disclosure and appended claims taken in conjunction with the above-described drawings.

This invention provides a means for overcoming excessive convective heat loss within the outer envelope of a metal halide arc discharge lamp. The invention will permit high efficacy, improved maintenance, and improved safety to be attained with metal halide lamps having substantial outer-envelope fill pressures.

Convective heat loss is caused by transporting heat from the arc tube to the outer envelope by means of gaseous convection currents in the atmosphere within the outer envelope. This invention substantially suppresses convection currents in the atmosphere laterally surrounding the arc tube. With the currents suppressed, there is no longer convective means for transporting heat from the arc tube to the outer envelope. Thus, convective heat loss likewise has been substantially suppressed.

Convection currents in a region may be quantitatively characterized by the Rayleigh Number. The Rayleigh Number is a dimensionless parameter used in studying convection flow in gases which expresses the balance between the driving buoyancy forces resulting from a temperature difference over the boundaries of the region and the diffusive process within the gas which retards the convective flow and tends to stabilize it. For a detailed treatment of the Rayleigh Number, see J. S. Turner, *Buoyancy Effects in Fluids,* Chapter 7, Cambridge University Press, 1973.

Convection currents will occur in a region only when the Rayleigh Number exceeds some critical value. Even after the critical value has been exceeded, the Rayleigh Number provides a useful measure of the extent of the convection flow in the region.

In the typical metal halide lamp, the heat lost through convection is considered to be excessive when it exceeds the heat lost through gaseous conduction. In the region between the arc tube and the outer envelope, the values of Rayleigh Number and convective heat loss are strongly dependent on two factors: the geometry of the lamp; and the pressure of the fill gas.

For a typical conventional lower wattage metal halide lamp, convective heat loss becomes excessive when the operating fill pressure approaches a maximum of approximately one-tenth of an atmosphere. For a typical lower wattage lamp employing this invention, convective heat loss becomes excessive when the operating fill pressure approaches a maximum of approximately one atmosphere.

Thus, this invention permits the extension of the upper limit of feasible operating outer-envelope fill pressures from, approximately, one-tenth of an atmosphere to one atmosphere in lower wattage metal halide lamps. The use of increased fill pressures within the outer envelope without excessive convective heat loss in these lower wattage lamps will provide significant advantages in the art.

One advantage of increasing the pressure of the fill in the outer envelope of a lower wattage lamp is reduced sodium loss. In the postulated electrolytic process, the accumulation of electrons on the outside of the arc tube draws sodium from inside to the outside of the arc tube. The presence of gas molecules in the fill between the metal parts and the arc tube impedes the migration of electrons to the arc tube. Increasing the pressure in the outer envelope increases the density of gas molecules in the atmosphere and thereby reduces sodium loss.

In lamps having a phosphor coating on the inside surface of the outer envelope, it is desirable to maintain the atmosphere of the outer envelope in a slightly oxidized state to avoid reduction of the phosphors. This may be achieved by providing a fill which is a slight oxidizing agent, such as nitrogen with a trace of oxygen. The introduction of such a fill at low pressure, e.g., having a cold pressure of one torr or less, substantially increases the possibility of an arc striking between the lead-in wires of the external circuit. The desired phosphor-maintenance stoichiometry may be achieved and the arc-over problem avoided by providing a slightly oxidized fill with a cold pressure in excess of 20 torr. This is another advantage of increasing the pressure of the fill in the outer envelope of lower wattage metal halide lamps.

Still another advantage of increased outer-envelope fill pressure in low wattage metal halide lamps is based on safety. If the outer envelope should be fractured for any reason, the implosion forces will be minimized when the pressure inside the envelope is as close as possible to the external atmospheric pressure.

In metal halide lamps of higher wattage, the advantages of reduced convective heat loss within the outer envelope will generally appear in improved performance characteristics of efficacy, color temperature, and luminous maintenance rather than in the form of increased gaseous pressure within the outer envelope as is the case with lamps of lower wattage.

Referring to the drawings with greater particularity, FIG. 1 shows a metal halide arc discharge lamp comprising outer envelope 10 with single-ended arc tube 12 positioned within outer envelope 10. Arc tube 12 contains a fill including metal halide additives 14, a portion of which generally remains in condensate form during continuous operation of the lamp. Arc tube 12 is mounted within outer envelope 10 by means of lead-in wires 16 and 17 which are welded to frame lead-in wires 18 and 19, respectively. Frame wires 18 and 19 are welded to support lead-in wires 20 and 21, respectively, which are imbedded in stem 22.

Ambient within outer envelope 10 is a gaseous fill 24, a portion of which is shown in the drawing as a collection of dots. Gaseous fill 24 is present at a sufficient pressure to be subject to convection currents during operation of the lamp. In this embodiment of the invention, convection-suppressing means 26 is a tubular sleeve 28 which is closed at its base 30 and open at its top 32; base 30 being the end of sleeve 28 closer to stem 22, and top 32 being the end of sleeve 28 closer to dome 34 of outer envelope 10. Mounting means 36 for sleeve 28 comprises of two metal straps 38 wrapped tightly around sleeve 28 and welded to stabilizing frame wire 39, the latter providing vertical stability for the entire frame by means of formed circular ring 40 which fits snugly into dome 34 of outer envelope 10. Convection-suppressing means 26 is mounted operatively with respect to arc tube 12 such that sleeve 28 encloses arc tube 12 laterally and base 30 encloses arc tube 12 about end 42 thereof.

Getter 44 is welded to stabilizing frame wire 39 below base 30 of sleeve 28. Getter 44 removes or getters hydrogen from fill 24. The flare of stem 22, not shown in the drawing, is hermetically sealed to outer envelope 10.

In order to have minimal effect on the luminous efficacy of the lamp, sleeve 28 should be highly transmissive of visible light. The luminous efficacy and color temperature of the lamp generally will be enhanced with higher operating temperatures and pressures within arc tube 12. Sleeve 28 should be relatively opaque to infrared radiation in order to minimize the heat loss from arc tube 12 through radiation. In embodiments where there may be a phosphor coating on the inside surface of outer envelope 10, sleeve 28 should be highly transmissive of the phosphor-energizing radiation. Examples of suitable materials from which sleeve 28 may be constructed are quartz, fused silica, and alumina. These materials have the ability to withstand the high temperatures about the arc tube, which may be as high as 700° C.

Stainless steel with a high chromium content is an example of a material suitable for use for the construction of metal straps 38 because of the material's superior high temperature properties, relatively low coefficient of thermal expansion, good resistance to oxidation and corrosion, and high tensile strength.

During continuous operation of the lamp, convection-suppressing means 26, comprising sleeve 28 in FIG. 1, prevents the formation of gaseous currents in fill 24 which would transport heat from arc tube 12 directly to outer envelope 10. However, convective heat loss might still occur in a two-step process: first, by transporting heat from arc tube 12 to sleeve 28 via convective currents in the region inside sleeve 28; second, by transporting heat from sleeve 28 to outer envelope 10 via convection currents in the region outside sleeve 28. This is why it is critical to control the Rayleigh Number either in the region inside or in the region outside sleeve 28. In the embodiment of FIG. 1, the radius of sleeve 28 is selected with respect to arc tube 12 such that the Rayleigh Number in the region inside sleeve 28 will be of sufficiently small magnitude to insure that the convective heat loss will not be excessive under operating conditions. As has been mentioned herein, the Rayleigh Number is dependent on the geometry of the region in which convection currents may occur. Since sleeve 28 forms one boundary of the region between arc tube 12 and sleeve 28, the radius of sleeve 28 may be determined to achieve proper control over the Rayleigh Number in the region under operating conditions. Thus, excessive heat loss through convective currents in the outer envelope fill has been substantially suppressed.

In the embodiment of FIG. 1, sleeve 28 reduces electrolytic sodium loss by impeding the migration of electrons from side rods 18 and 19 to arc tube 12 although electrons will accumulate on sleeve 28. Because sleeve 28 has a greater surface area than arc tube 12, the electric field created by the electron accumulation on sleeve 28 is weaker than would be caused by an accumulation on arc tube 12. The result is that the rate of sodium migration through arc tube 12 is reduced by the presence of sleeve 28. The diminished sodium loss translates into improved luminous maintenance of the lamp. This advantage will occur in any embodiment having a convection-suppressing enclosure about the arc tube.

The lamp in FIG. 1 is intended to be operated vertically, either base down or base up. It is required that sleeve 28 be closed on at least one end, at base 30, or top 32, or both. If both base 30 and top 32 were open, the convection flow would not be substantially impeded. This phenomenon has been corroborated in laboratory tests. With a sleeve open at both ends, there is an upwards flow along the arc tube walls in the region inside the sleeve, the so-called "chimney effect," and a downwards flow along the walls of the outer envelope in the region outside the sleeve. These currents will transport heat from the arc tube to the outer envelope resulting in appreciable convective heat loss. Therefore, it is critical that sleeve 28 be closed on at least one end.

In other embodiments, the enclosure or sleeve may be closed on both ends. A sleeve closed at both ends does have a convection suppressing effect, but it is more difficult to construct a lamp with such a sleeve.

The lamp of FIG. 1 may be operated horizontally with limited convection-suppressing effect. The effect will not be optimum. Significant convective heat loss will occur at a lower Rayleigh Number than would be the case if the lamp were operated vertically. Nevertheless, the operating characteristics of the lamp will be improved significantly in comparison with the same lamp operated horizontally without the convective-suppressing means.

Figure 2:
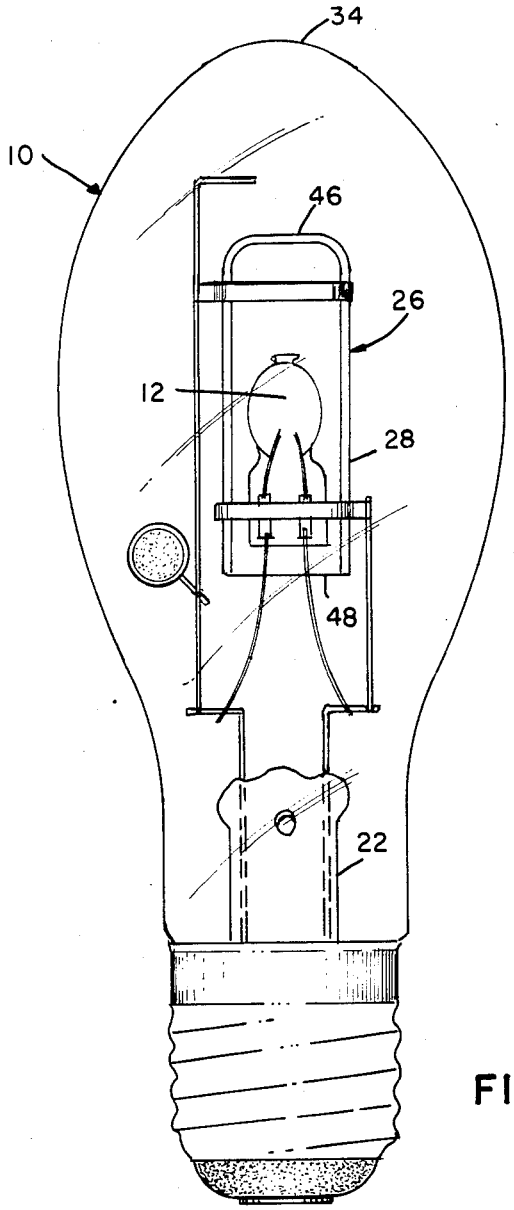
FIG. 2 is an elevational view of another embodiment of the invention in a metal halide lamp with a single-ended arc tube.

FIG. 2 shows another embodiment of the invention in a metal halide lamp with a single-ended arc tube. In this embodiment, convection-suppressing means 26 comprises tubular sleeve 28 with its top 46 closed and its base 48 open; top 46 being the end of sleeve 28 closer to dome 34 of outer envelope 10, and base 48 being the end of sleeve 28 closer to stem 22.

The lamp of FIG. 2 is intended for vertical operation, either base down or base up. The lamp may be operated horizontally with substantial, but less than optimum, convection-suppressing effect.

Figure 3:
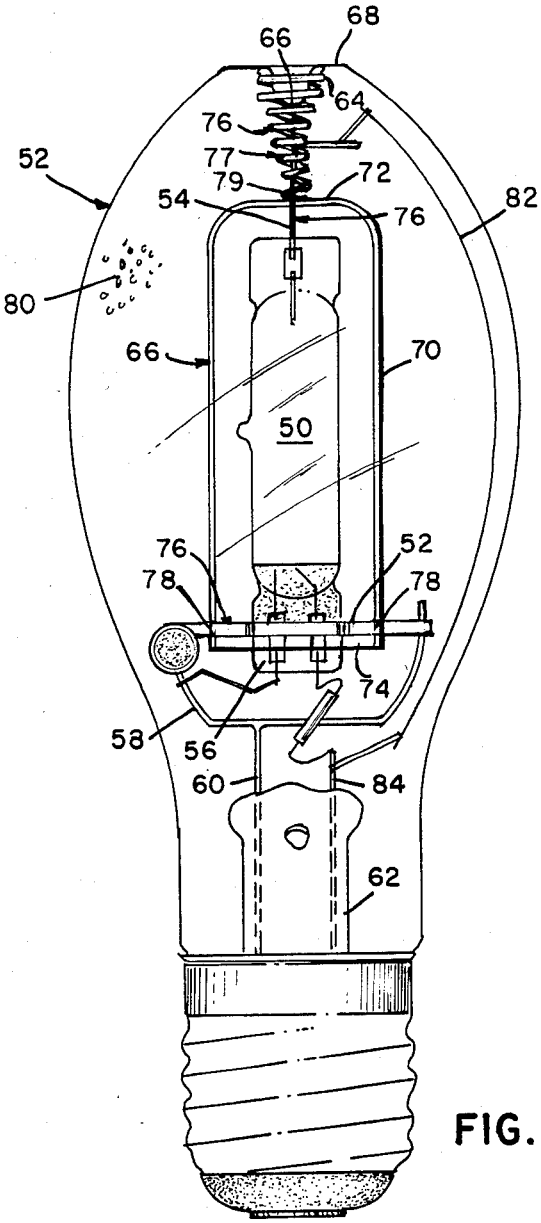
FIG. 3 is an elevational view of another embodiment of the invention in a metal halide lamp with a double-ended arc tube.

FIG. 3 shows another alternate embodiment of the invention in a metal halide lamp with a double-ended arc tube 50 mounted within outer envelope 52. Arc tube 50 is mounted by means of metal strap 52 and lead-in support wire 54. Strap 52 is tightly wrapped around press seal 56 of arc tube 50 and welded to stiff frame lead-in wire 58. Frame wire 58 is welded to stiff lead-in wire 60 emanating from stem 62. Support lead-in wire 54 is inserted into narrow end 79 of spring 77 along the central axis of spring 77. Lead-in wire 54, so mounted in spring 77, provides vertical stability to the internal structure by means of dimple-engaging end 64 of spring 77 which engages dimple 66 formed in the dome 68 of outer envelope 52.

Convection-suppressing means 66 in this embodiment is a tubular sleeve 70 with its top 72 closed and its base 74 open; top 72 being the end of sleeve 70 closer to dome 68, and base 74 being the end of sleeve 70 closer to stem 62.

In this embodiment, mounting means 76 for sleeve 70 comprises spring 77, lead-in wire 54, and metal strap 52. Lead-in wire 54 fits snugly through a hole in top 72 of sleeve 70. Sleeve 70 has two notches 78 bordering on base 74 which fit over metal strap 52. Notches 78 remain engaged over strap 52 because of the force exerted on sleeve 70 in the direction of stem 62 by spring 77. With the mounting system as described, sleeve 70 will remain coaxially aligned with regard to arc tube 50. The geometry of the region inside sleeve 70 and laterally surrounding arc tube 50 will remain fixed, and the convection suppressing properties, e.g., the values of the Rayleigh Number under operating conditions, of the region will be maintained.

Fill 80, a portion of which is shown as a collection of dots in the drawing, is ambient within outer envelope 52 and subject to convection currents during operation of the lamp. Bowed wire 82 electrically connects the topmost electrode to lead-in wire 84.

For identical reasons as stated herein respecting the lamp of FIG. 1, convection currents within the outer envelope of the lamp of FIG. 3 will be substantially suppressed during continuous operation of the lamp even where the operating outer-envelope fill pressure exceeds one-tenth of an atmosphere.

The lamp of FIG. 3 is intended to be operated vertically, with base down. There are further alternate embodiments of the invention with double-ended arc tubes which may be operated vertically with base up or may be operated horizontally.

In most embodiments, the convection-suppression means may provide the additional benefit of being a containment device in the event of a burst of the arc tube. For example in the embodiment of FIG. 3, sleeve 70 will restrain shards of arc tube 50 from shattering outer envelope 52 in the event arc tube 50 should burst for any reason. Furthermore, spring 77 and lead-in wire 54 cooperate with sleeve 70 in the performance of the containment function; these components acting together will absorb a portion of the energy of an arc tube burst, and they will divert the remainder of such energy toward the base of the lamp where it is least likely to cause damage to outer-envelope 52.

Figure 4:
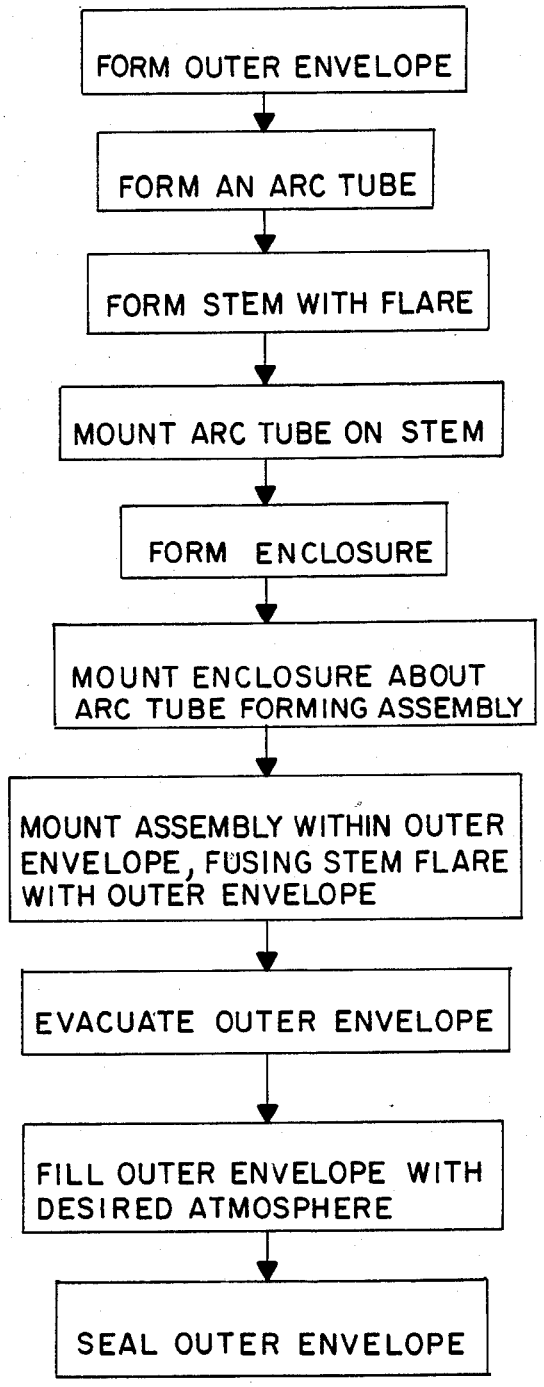
FIG. 4 is a flow diagram of a method of constructing a metal halide lamp with a convection-suppressing enclosure.

FIG. 4 is a flow diagram of a method of constructing a metal halide arc discharge lamp with convection-suppressing enclosure. The method comprises the following steps: forming an outer envelope; forming an arc tube containing a fill including metal halide additives; forming a stem having a flare; mounting the arc tube on the stem; forming an enclosure; mounting the enclosure about the arc tube to form an assembly; mounting the assembly within the outer envelope, fusing the stem flare with the outer envelope; evacuating the outer envelope; filling the outer envelope with a desired atmosphere; and sealing the outer envelope.

Thus, there is provided a metal halide arc discharge lamp with convection-suppressing means which provides substantially improved operating characteristics; and methods of operating and constructing such lamps.

While there have been shown and described what are at present considered to be the preferred embodiments of the invention, it will be apparent to those skilled in the art that various changes and modifications can be made herein without departing from the scope of the invention as defined by the appended claims.

We claim:

1. A metal halide arc discharge lamp comprising:

(a) an outer envelope;

(b) an arc tube positioned within said outer envelope, said arc tube having a fill including metal halide additives;

(c) a gaseous fill within said outer envelope, said fill being subject to convection currents during operation of said lamp; and (d) convection-suppressing means for suppressing convection currents within said fill of said outer envelope, said convection-suppressing means being shaped and mounted with respect to said arc tube such that the value of the Rayleigh Number in the atmosphere laterally surrounding said arc tube is less than $5\times10^4$ during continuous operation of said lamp.

2. The metal halide arc discharge lamp of claim 1 wherein said convection-suppressing means comprises:

(a) an enclosure within said outer envelope, said enclosure surrounding said arc tube laterally and about at least one end thereof, said enclosure being transmissive of visible light; and (b) mounting means to mount and support said enclosure within said outer envelope.

3. The metal halide arc discharge lamp of claim 2 wherein said arc tube contains a fill including sodium.

4. The metal halide arc discharge lamp of claim 3 wherein said outer envelope has a phosphor coating on the interior surface thereof.

5. The metal halide arc discharge lamp of claim 4 wherein the pressure inside said outer envelope during continuous operation of said lamp is greater than one-tenth of an atmosphere.

6. The metal halide arc discharge lamp of claim 5 wherein said arc tube is double-ended.

7. The metal halide arc discharge lamp of claim 5 wherein said arc tube is single-ended.

8. The metal halide arc discharge lamp of claim 7 wherein the operating power of said lamp is 100 watts or less.

9. The metal halide arc discharge lamp of claim 8 wherein said metal-halide additives within said arc tube are partially vaporized at full operating temperature and pressure of said lamp.

10. A method of improving the operating characteristics of a metal halide arc discharge lamp having an outer envelope, an arc tube containing a fill including metal halide additives, and a gaseous fill within said outer envelope, said fill being subject to convection currents during operation of said lamp, said method comprising the step of substantially suppressing convection currents within said outer envelope such that the value of the Rayleigh Number in the atmosphere laterally surrounding said arc tube is less than $5\times10^4$ during continuous operation of said lamp.

11. The method of claim 10 wherein said metal halide additives within said arc tube are partially vaporized at full operating temperature and pressure of the lamp.

* * * * *